US008436284B1

(12) United States Patent
Kirshman et al.

(10) Patent No.: US 8,436,284 B1
(45) Date of Patent: May 7, 2013

(54) CAVITY FLOW SHOCK OSCILLATION DAMPING MECHANISM

(75) Inventors: David J. Kirshman, Huntington Beach, CA (US); David A. Deamer, Seal Beach, CA (US)

(73) Assignee: The Boeing Company, Chicago, IL (US)

( * ) Notice: Subject to any disclaimer, the term of this patent is extended or adjusted under 35 U.S.C. 154(b) by 788 days.

(21) Appl. No.: 12/623,412

(22) Filed: Nov. 21, 2009

(51) Int. Cl.
*F42B 10/02* (2006.01)

(52) U.S. Cl.
USPC ..... 244/3.16; 244/35 A

(58) Field of Classification Search ..... 244/35 A, 244/200.1, 199.1, 198, 3.16, 1 R, 1 N, 117 R, 244/129.1, 130
See application file for complete search history.

(56) References Cited

U.S. PATENT DOCUMENTS 4,568,040 A * 2/1986 Metz ..... 244/3.22
4,598,884 A * 7/1986 Speer ..... 244/3.16
4,850,275 A 7/1989 Utreja et al.
6,857,604 B2 * 2/2005 Schmidt ..... 244/130
8,141,811 B2 * 3/2012 Kremeyer ..... 244/1 N
2008/0272241 A1 * 11/2008 Brulhart ..... 244/200.1

OTHER PUBLICATIONS

Heller et al. "Flow-Induced Pressure Oscillations in Shallow Cavities," Technical Report AFFDL-TR-70-104, Ecember 1970.
Engblom et al. :Fluid Dynamics of Unsteady Cavity Flow, Institute for Advanced Technology, The University of Texas at Austin, Nov. 1996.
Bazyma et al. "Stabilization of Blunt Nose Cavity Flows by Using Energy Deposition" Journal of Spacecraft and Rockets, vol. 42, No. 5, Sep.-Oct. 2005, p. 790.
Huebner et al. "Mach 10 Bow-Shock Behavior of a Forward-Facing Nose Cavity," Journal of Spacecraft and Rockets, vol. 30, No. 3, May-Jun. 1993, p. 290.
Ladoon et al. "Physics of Resonance in a Supersonic Forward-Facing Cavity," Journal of Spacecraft and Rockets, vol. 35, No. 5, Sep.-Oct. 1998, p. 625.

* cited by examiner

*Primary Examiner* — Timothy D Collins
*Assistant Examiner* — Joshua Huson
(74) *Attorney, Agent, or Firm* — Novatech IP Law

(57) ABSTRACT

A pressure oscillation damping mechanism comprises a cavity having an entrance exposed to fluid flowing on an exterior of the cavity. The damping mechanism may include a constriction positioned adjacent to the entrance and being sized to dampen an amplitude of the pressure oscillations occurring within the cavity.

26 Claims, 8 Drawing Sheets

CAVITY FLOW SHOCK OSCILLATION DAMPING MECHANISM

CROSS-REFERENCE TO RELATED APPLICATIONS (Not Applicable)

STATEMENT RE: FEDERALLY SPONSORED RESEARCH/DEVELOPMENT (Not Applicable)

FIELD

The present disclosure relates generally to aerodynamics and, more particularly, to a mechanism for reducing pressure oscillations within a cavity exposed to supersonic or hypersonic flow.

BACKGROUND

Certain vehicles such as cruise missiles, interceptors, re-entry vehicles and high-speed aircraft may operate in the supersonic and hypersonic flight regimes. Such vehicles must be capable of withstanding significant heat loads caused by aero-thermal heating of the outer surface of the vehicle. For example, the nose tip of a missile flying at hypersonic speeds at low altitude can reach stagnation temperatures exceeding the melting point of tungsten (approximately 6,000° F.). Such heating can result in material ablation which can alter the shape of the nose affecting the aerodynamics and controllability of the missile.

For certain hypersonic vehicles such as missile interceptors, an optical sensor for target acquisition may be located at the nose of the vehicle and is preferably oriented in a forward-facing direction for optimal signal transmission. The sensor is typically covered by a sensor window which must be capable of withstanding the extreme heat environment at the nose tip. For example, the sensor window may be formed of sapphire due to its favorable optical and mechanical properties at elevated temperatures.

Optical signals from the optical sensor must pass through a bow shock wave which typically forms at a location forward of a missile or other blunt-nosed object in supersonic or hypersonic flow. The bow shock is typically detached from the object and at lease partially envelopes the nose section.

One prior art mechanism for regulating the temperature of the sensor window is by actively cooling the window with a thin film of fluid. However, such cooling systems require high pressure purge gas and associated plumbing as well as an activation system, all of which add complexity and weight to the vehicle. Furthermore, the thin film of fluid on the sensor window may affect optical signal quality.

Another approach to reducing the temperature of the sensor window is to relocate the window from the forward-most point on the nose tip to a relatively lower temperature area along the side of the nose. Although the heating environment may be more favorable, the quality of optical signal transmission may be adversely affected. For example, as compared to optical signals transmitted from a centrally-located window at the nose tip where the signals pass through the bow shock at a perpendicular angle, optical signals from a side-located window must travel through the bow shock layer at an oblique angle which may reduce signal quality.

Another approach to reducing the temperature of the sensor window is to locate the window at the base of a forward-facing cavity formed in the nose tip. Placement of the optical sensor window at the basewall of the cavity has been shown to be an effective means for reducing heat transfer as compared to heat transfer at a sensor window integrated into a forward-most location of a conventional nose. For example, the heat flux measured at the cavity basewall of a forward-facing cavity may be an order of magnitude less than the heat flux measured at the stagnation point of a conventional convex nose tip.

However, one characteristic of forward-facing cavities in supersonic or hypersonic flow are oscillations in pressure that occur within the cavity. The pressure oscillations are driven by cavity geometry and can affect vehicle performance and optical signal quality. For example, such pressure oscillations in the cavity can cause an increase in heating at the cavity basewall as compared to a cavity with non-oscillating pressure. The frequency of such pressure oscillations has been found to closely correspond to the organ-pipe frequency associated with resonance tube theory wherein the frequency is a function of cavity depth.

A further characteristic associated with cavity pressure oscillations are oscillations that are induced in the bow shock. The cavity-driven bow shock oscillations occur at relatively high amplitudes resulting in large fluctuations in aerodynamic drag of the vehicle. In this regard, bow shock oscillations complicate vehicle control and interfere with optical signal transmission which may compromise target tracking.

Attempts to reduce or dampen the amplitude of such bow shock oscillations include the injection of pressurized gas such as helium into the cavity in an attempt to stabilize the cavity pressure fluctuations. Attempts to dampen bow shock oscillations also include the application of pulsed energy to the cavity such as by using laser energy in order to stabilize the pressure fluctuations. However, such systems require additional hardware which adds to vehicle complexity and weight.

As can be seen, there exists a need in the art for a system and method for damping pressure oscillations occurring within a cavity in order to minimize heating of a sensor window at the cavity basewall. Furthermore, there exists a need in the art for a system and method for reducing bow shock oscillations in order to minimize fluctuations in vehicle drag and improve vehicle controllability. Ideally, such a damping system is simple in construction and low in cost.

SUMMARY

The above-noted needs associated with cavity pressure oscillations and bow shock oscillations are specifically addressed and alleviated by the present disclosure which provides a passive mechanism for damping pressure oscillations occurring within a cavity of an article subjected to high-speed flow.

In an embodiment, disclosed is a pressure oscillation damping mechanism comprising a cavity having an entrance that is disposed adjacent to fluid flowing exteriorly to the cavity. The fluid on the exterior may be moving at a supersonic (e.g., Mach 1-5) and/or a hypersonic velocity (e.g., Mach 5 and above) relative to the article within which the cavity is installed. For example, the cavity may be formed within a nose section of a vehicle which may be moving relative to a free stream fluid at supersonic or hypersonic velocity.

The damping mechanism may comprise a constriction which may be positioned adjacent to the entrance and which may be sized to dampen pressure oscillations occurring within the cavity. The cavity may include a cavity sidewall which may extend aftwardly from the entrance to a cavity basewall such that the cavity basewall defines an end of the cavity opposite the constriction. In an embodiment, the cavity may be planar in shape and may be oriented in substantially perpendicular relation to the cavity axis. The cavity may be formed at any location and in any orientation on the vehicle. For example, the cavity may be formed on a lateral side of the vehicle and may be oriented in substantially non-parallel relation to the free stream direction of fluid through which the vehicle is moving. The constriction may be sized to minimize oscillations in pressure acting on the cavity basewall in order to minimize heat transfer to the cavity basewall.

In a further embodiment, the present disclosure includes a vehicle which may comprise a body portion having forward and aft ends and which may define a longitudinal axis and having an outer mold line. A cavity may be formed in the body portion. The cavity may have an entrance that is positioned adjacent to fluid flowing exteriorly relative to the cavity. As indicated above, the fluid may be flowing at a supersonic velocity and/or a hypersonic velocity or any combination thereof or at any other velocity outside of the supersonic or hypersonic range. The cavity may include the constriction which may be positioned adjacent to the entrance and which may be sized to dampen pressure oscillations occurring within the cavity. In this manner, the constriction may dampen oscillations of a bow shock which may be formed in detached relation to the vehicle at a location generally forward of the vehicle and at least partially enveloping the vehicle.

In a further embodiment, included is a method of damping oscillations of the bow shock of the vehicle. The method may comprise the steps of providing a forward-facing cavity in the vehicle such as in the nose section. The cavity has an entrance and a constriction positioned adjacent to the entrance. The methodology may comprise moving the vehicle relative to a free stream flow of fluid moving at a hypersonic or supersonic velocity such that a bow shock is formed and which at least partially envelopes the vehicle. The method may further comprise damping an amplitude of the pressure oscillations occurring within the cavity in order to cause the damping of an amplitude of the bow shock oscillations. By damping the bow shock oscillations, variations in aerodynamic drag may be reduced which may reduce drag and improve vehicle controllability. Likewise, by reducing pressure oscillations within the cavity, cavity basewall heating may be reduced and transmission of optical signals from the cavity basewall through the cavity may likewise be improved which may enhance imaging, target tracking and/or target seeking.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numbers refer to like parts throughout and wherein.

DETAILED DESCRIPTION

Figure 1:
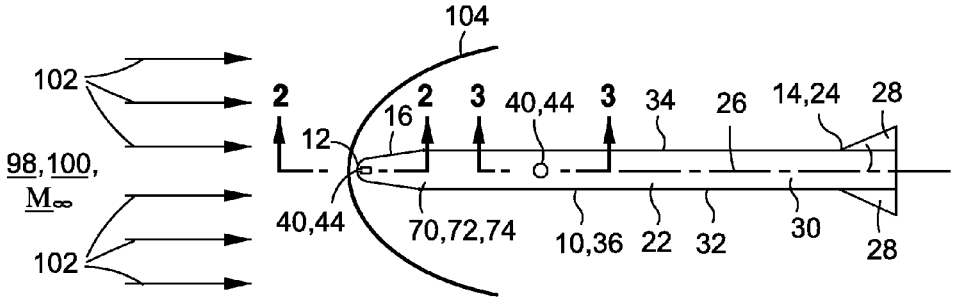
FIG. 1 is a side illustration of a vehicle having a forward-facing cavity incorporated into a nose section of the vehicle and further illustrating a bow shock enveloping the nose section.
Figure 2:
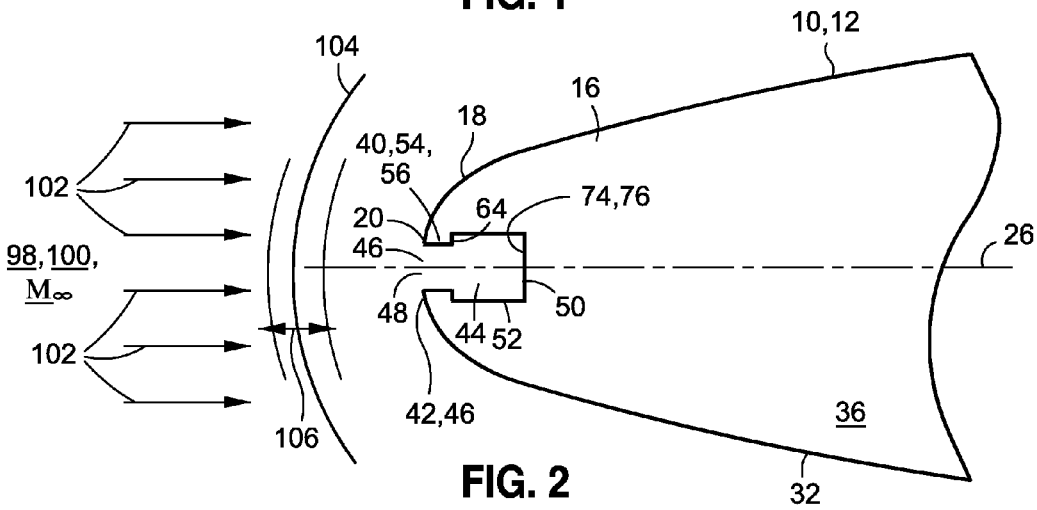
FIG. 2 is an enlarged sectional illustration of the nose section taken along line 2-2 of FIG. 1 and illustrating a constriction positioned adjacent an entrance to the cavity and configured to dampen an amplitude of pressure oscillations occurring within the cavity.
Figure 3:
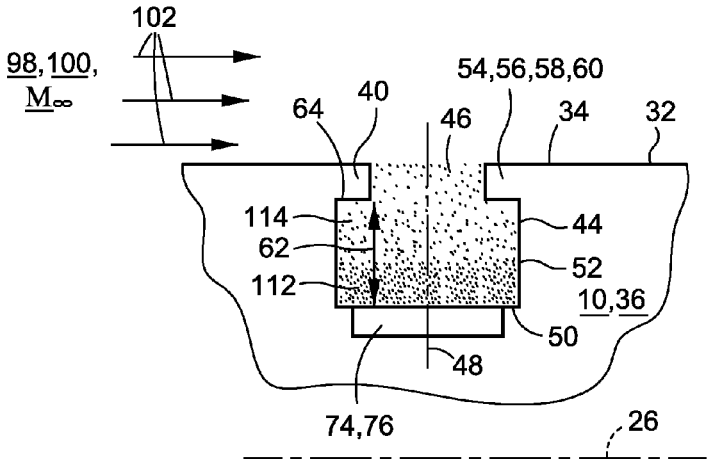
FIG. 3 is a sectional illustration of a lateral side of the vehicle taken along line 3-3 of FIG. 1 and illustrating the cavity incorporated thereinto and being oriented substantially perpendicularly relative to a free stream flow relative to the vehicle.
Figure 4:
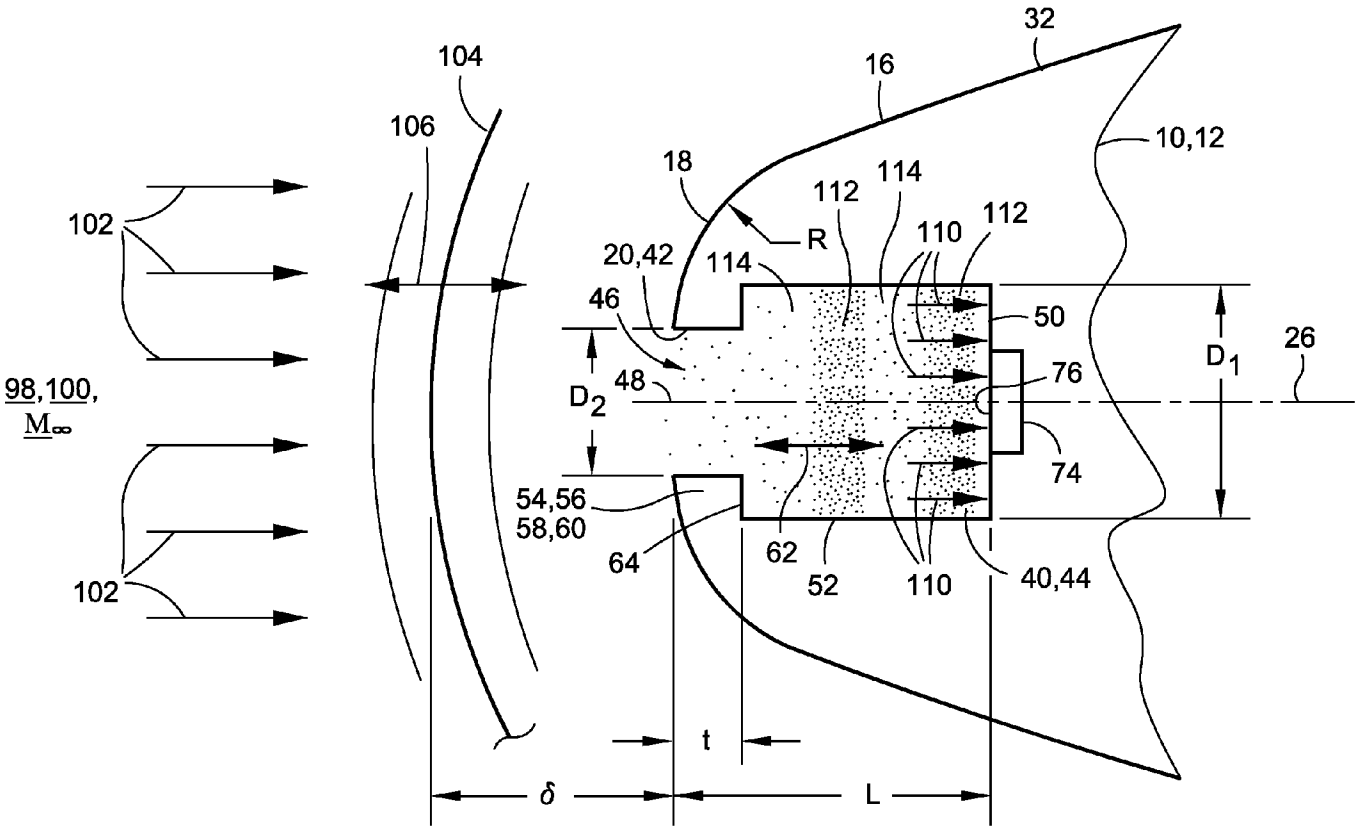
FIG. 4 is an enlarged sectional illustration of the nose section illustrating compression and rarefaction components of pressure oscillations occurring within the cavity.

Referring now to the drawings wherein the showings are for purposes of illustrating preferred and various embodiments of the disclosure only and not for purposes of limiting the same, shown in FIG. 1 is a perspective illustration of a vehicle 10 having a cavity 44 located at a forward end 12 of the vehicle 10. The cavity 44 includes a damping mechanism 40 for damping pressure oscillations 62 occurring within the cavity 44. As best seen in FIGS. 2 through 4, the damping mechanism 40 comprises an annular lip 60 which functions as a choke mechanism 54 to prevent pressure oscillations 62 in the cavity 44 from influencing a bow shock 104 which may be formed forward of the nose section 16 of the vehicle 10. As will be described in greater detail below, the constriction 58 at the forward end 12 of the cavity 44 acts as a shock damper 56 and forces a gas dynamic choke condition which results in damping of the amplitude of the bow shock oscillations 106.

Although FIG. 1 illustrates the cavity 44 with constriction 58 as being positioned at the forward end 12 of the vehicle 10 in the bow 18 or nose section 16, the cavity 44 may be positioned at any location along the vehicle 10 such as along a lateral side 34 of the vehicle 10 as best seen in FIG. 3 or at any other location on the vehicle 10. Further in this regard, the choke mechanism 54 (i.e., constriction 58) for damping cavity pressure oscillations 62 is not limited to installation on a vehicle 10 but may be implemented in any vehicular or non-vehicular application subjected to high speed flow including, but not limited to, flow in the supersonic (i.e., Mach 1-5) and hypersonic (i.e., Mach 5 and above) ranges. For example, the cavity 44 and choke mechanism 54 may be implemented in any structure including stationary structures such as a test article in a wind tunnel or shock tunnel.

In this regard, it is contemplated that the choke mechanism 54 may be implemented in any cavity 44 that is subject to pressure fluctuations. For cavity installations associated with shock waves such as a bow shock 104, the constriction 58 in the cavity 44 advantageously attenuates or dampens oscillations bow shock oscillations 106. In vehicular applications, the choke mechanism 54 may be implemented in a cavity 44 formed in as any one of a variety of different vehicle configurations operating in supersonic or hypersonic flow and including, without limitation, projectiles, missiles such as interceptor missiles or cruise missiles, re-entry vehicles, and hypersonic or supersonic aircraft.

For example, the vehicle 10 illustrated in FIG. 1 may represent a missile having a body portion 36 including a nose section 16 at a forward end 12 and an aft section 24 at an aft end 14 separated by a mid section 22. The vehicle 10 may include aerodynamic surfaces for maneuvering the vehicle 10 and/or generating lift such as fins 28, canards, wings or other aerodynamic lifting and/or control surfaces. The vehicle 10 may include a propulsion system 30 for propelling the vehicle 10 and a guidance and control system which may be mounted at any location within the vehicle 10.

Referring to FIG. 2, shown is the nose section 16 of the vehicle 10 having the cavity 44 mounted therein. The cavity 44 is defined by a cavity sidewall 52 extending aftwardly from the cavity 44 entrance 46 to a cavity basewall 50. A tracking system and/or control system 70, 72 may be mounted in the nose section and may include an imaging system such as a target sensor 74. The target sensor may include a sensor window 76 which may form at least a portion of the cavity basewall 50. As indicated above, by mounting the window 76 at the cavity basewall 50, the heat load on the window 76 may be reduced compared to the heat load at the forward-most point of a conventional convex nose section.

Referring to FIGS. 2 and 3, shown is the bow shock 104 which forms at a location forward of the nose section 16 when the vehicle 10 is moving in relation to oncoming fluid 98 flowing at a free stream Mach number $M_\infty$ within the supersonic and/or hypersonic ranges. The free stream 100 fluid 98 is illustrated as moving along a flow direction 102 relative to the longitudinal axis 26 of the vehicle 10. The bow shock 104 forms in detached relation to the nose section 16 at a standoff distance $\delta$ as measured from the nose tip 20 to the mean bow shock 104 position as shown in FIG. 4. The bow shock 104 may oscillate along the indicated direction 106 under the influence of undamped pressure oscillations 62 in the cavity 44.

More specifically, at the formation of the bow shock 104, oscillations of the bow shock 104 initially occur at relatively high amplitudes driven by pressure oscillations 62 within the cavity 44 as shown in FIG. 4. However, the constriction 58 at the entrance 46 of the cavity 44 causes a gas dynamic choke condition that dampens the pressure oscillations 62 within the cavity 44 which, in turn, dampens the amplitude of bow shock oscillations 106. Advantageously, the damping of the pressure oscillations 62 within the cavity 44 facilitates a reduction in heating at the window 76 in the cavity basewall 50. More specifically, the incorporation of the constriction 58 at the cavity 44 entrance 46 reduces pressure fluctuations. Such pressure fluctuations are best seen in FIG. 4 as comprising alternating compression 112 and rarefaction 114 waves which increase cavity basewall 50 heating each time a compression 112 wave reflects off of the cavity basewall 50.

Referring to FIG. 3, shown is the cavity 44 incorporated into a lateral side 34 of the vehicle 10 such that the cavity axis 48 is oriented in non-parallel relation to the free stream 100 fluid flow direction 102. In this regard, the free stream 100 flow in FIG. 3 is illustrated as moving tangentially to the outer mold line 32 and over the cavity 44 entrance 46 as distinguished from the normal or perpendicular orientation of the free stream 100 flow direction 102 relative to the forward-facing cavity 44 at the nose section 16 of the vehicle 10 as illustrated in FIGS. 1, 2 and 4. It should be noted that although the drawing figures illustrate only two orientations (i.e., perpendicular and parallel) of the cavity 44 relative to the free stream 100 flow direction 102, the cavity 44 may be formed at any orientation relative to the free stream 100 flow direction 102. For example, the cavity axis 48 may be oriented in any direction relative to the outer mold line 32 of the vehicle 10 or structure within which the cavity 44 is installed.

Referring to FIGS. 3 and 4, shown are cavity 44 pressure oscillations 62 which may occur within the cavity 44 at the initial formation of the bow shock or which may continue in cavities where pressure oscillations lack a choke mechanism 54. The pressure oscillations 62 may be comprised of the alternating compression 112 and rarefaction 114 waves which may periodically reflect off of the cavity basewall 50 causing oscillations in the magnitude of pressure 110 acting on the cavity basewall 50. The compression 112 waves have a higher density than the rarefaction 114 waves such that the compression 112 waves have a greater heat capacity than the rarefaction 114 waves. The constriction 58 in the cavity 44 may minimize heat transfer to the cavity basewall 50 that occurs each time a compression 112 wave reflects off of the cavity basewall 50 by reducing the amplitude of the pressure 110 acting on the cavity basewall 50. In this manner, the constriction 58 reduces the net heat input to the cavity basewall 50 and to the sensor window 76 that may be incorporated into the cavity basewall 50.

Referring to FIG. 4, shown is an embodiment of a forward-facing cavity 44 located at the nose section 16 and having the constriction 58 incorporated thereinto. The constriction 58 may be configured such that the vehicle 10 outer mold line 32 defines an outer surface of the constriction 58. The inner boundary of the constriction 58 may be formed as an annular step 64 or shoulder extending radially to the cavity sidewall 52. Although illustrated as being formed at a ninety degree angle (i.e., perpendicular) relative to the cavity sidewall 52, the step 64 may be formed at any angle and is not limited to the perpendicular arrangement illustrated in the drawing figures. In this regard, the step 64 may be provided in any size, shape and configuration that optimizes vehicle 10 performance while effectively damping the bow shock 104 oscillations. In addition, the constriction 58 may be formed at any constriction thickness t and may be sized in consideration of a number of factors including, but not limited to, the operating loads (e.g., structural, thermal) imposed on the constriction 58. The constriction 58 geometry may also be sized and configured in consideration of the cavity 44 geometry which, in turn, may be driven by a variety of factors such as aerodynamic, acoustic and/or thermal factors and/or physical requirements for packaging the sensor window 76 in the cavity basewall 50.

For example, referring to FIG. 4, pressure oscillations 62 within the cavity 44 may be a function of cavity 44 geometry and, more particularly, a function of cavity depth indicated by reference character L and measured from the nose tip 20 at the outer mold line 32 to the cavity basewall 50. In this regard, the cavity 44 pressure and the bow shock 104 may oscillate near the resonant frequency of the cavity 44.

Referring to FIG. 4, the constriction 58 geometry may be sized in consideration of the cavity 44 geometry in order to achieve a desired damping of the bow shock oscillations 106. For example, as shown in FIG. 4, the cavity 44 defines a cavity 44 width. Likewise, the constriction 58 defines a constriction width $D_2$ which is preferably less than the cavity width $D_1$. The ratio of the constriction width $D_2$ to the cavity width $D_1$ (i.e., the cavity width ratio) may be in the range of from approximately 0.3 to approximately 0.7 and preferably approximately 0.5. As indicated in computer simulations (e.g., CFD) described in detail below, such geometric sizing ratios of the constriction width $D_2$ to cavity width $D_1$ may effectively dampen bow shock oscillations 106.

Referring still to FIG. 4, the above-mentioned cavity width ratio may be associated with a range of cavity depths L or aspect ratios of the cavity depth L to cavity width $D_1$. For example, the ratio of the cavity depth L to cavity width $D_1$ (i.e., cavity depth ratio) may be in the range of from approximately 0.5 to approximately 1.5 and preferably approximately 1.0. However, the cavity width ratio and cavity depth ratio may be provided at any value and are not to be construed as being limited to the specific ranges recited above. Sizing of the constriction 58 and/or cavity 44 may be dependent upon factors including, but not limited to, the local radius R of the nose section 16 at the entrance 46, the stagnation temperature at the nose tip 20, and the free stream Mach number $M_\infty$ and Reynolds number of the operating environment. Likewise, the cavity 44 may be provided in a variety of different shapes. For example, the cavity sidewall 52 may be provided in a cylindrical configuration as illustrated in the FIGS. 1-4 although the cavity basewall 50 may be provided in any one of a variety of shapes.

The cavity basewall 50 may define a generally planar surface which may preferably, but optionally, be oriented in generally perpendicular relation to the cavity axis 48. Likewise, the cavity 44 may be oriented such that the cavity axis 48 is generally aligned with the longitudinal axis 26 of the vehicle 10. For example, the cavity axis 48 may be generally aligned with the free stream 100 flow direction 102 at a zero angle of attack of the vehicle 10. However, the cavity 44 may be oriented in any direction or orientation and is not limited to alignment with a particular vehicle 10 feature or with the free stream 100 flow direction 102. Furthermore, the cavity 44 may be positioned at any location on the vehicle 10 and is not limited to the forward-facing location illustrated in FIGS. 1, 2 and 4. Likewise, the constriction 58 may be provided in any one of a variety of different geometric shapes and/or sizes. For example, the constriction 58 may define a generally circular-shaped opening at the entrance 46 to the cavity 44.

Furthermore, the constriction 58 is not limited to being formed as a continuous annular lip 60 extending around the entrance 46 of the cavity 44 but may be formed as discrete or localized lip segments (not shown) spaced in angular relation to one another around the entrance 46 of the cavity 44. It should also be noted that constriction 58 is not limited to being positioned at the extreme forward end 12 of the cavity 44 but may be located at any position along the cavity sidewall 52 between the cavity basewall 50 and the cavity 44 entrance 46. Even further, it is contemplated that the constriction 58 may comprise one or more constrictions 58 of equal and/or varying size formed at different locations along the cavity sidewall 52.

As indicated above, the constriction 58 is preferably sized and configured to dampen pressure oscillations 62 within the cavity 44 which are understood to drive the bow shock oscillations 106. As such, the constriction 58 dampens the pressure oscillations 62 which, in turn, dampen the amplitude of the bow shock oscillations 106. Advantageously, the damping of the bow shock oscillations 106 may minimize fluctuations or variations of aerodynamic drag of the external surfaces of the vehicle 10. Reduction in drag variations may improve vehicle 10 controllability as compared to a vehicle 10 subjected to undamped bow shock oscillations 106.

Figure 5:
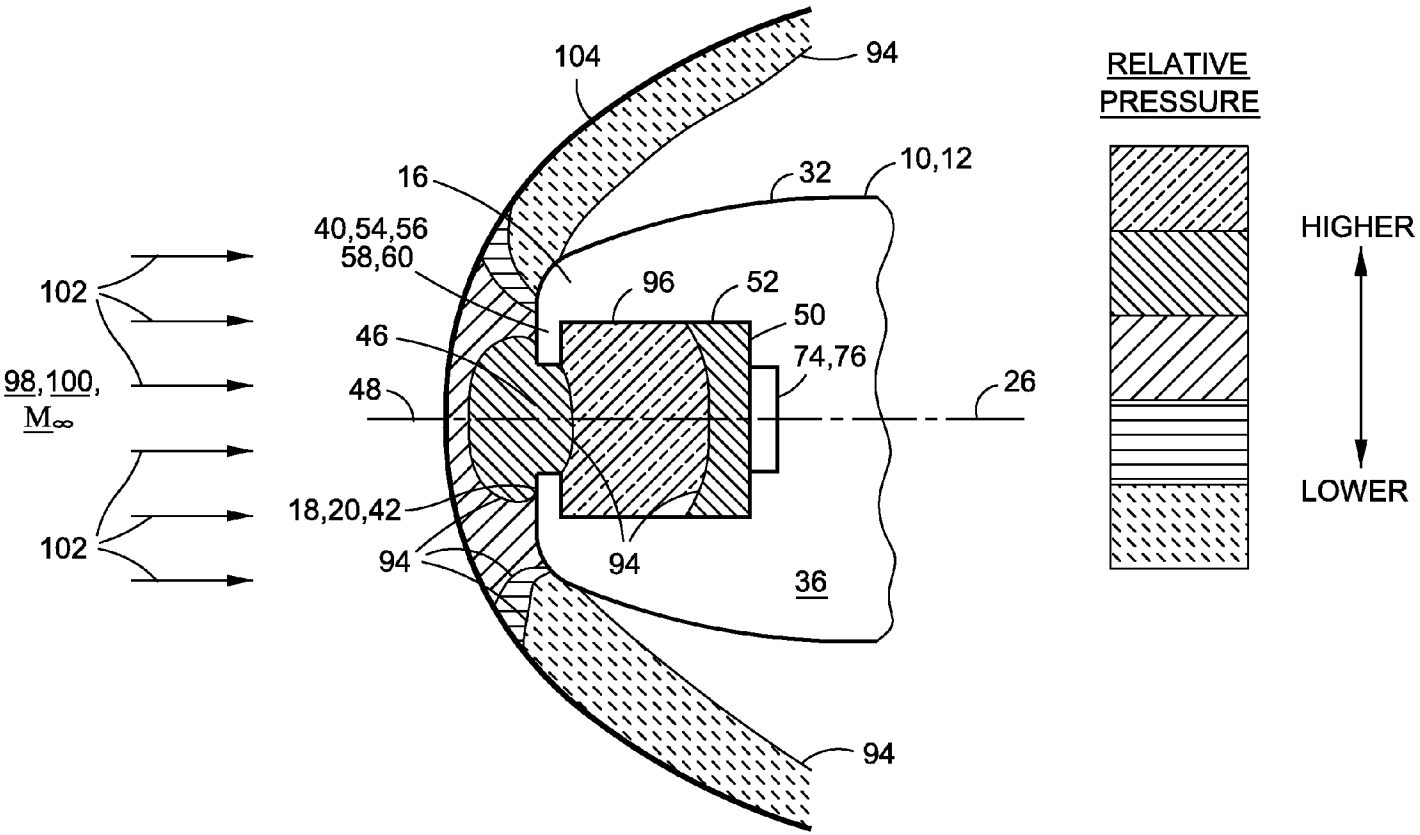
FIG. 5 is a computer (e.g., computational fluid dynamics (CFD)) simulation of an embodiment of a nose section having a constriction formed on a forward end of the cavity and illustrating pressure contours associated with hypersonic flow relative to the vehicle.

Referring to FIG. 5, shown is a computer (i.e., a computational fluid dynamics (CFD)) simulation of a nose section 16 of a vehicle 10 subjected to Mach 8 (i.e., hypersonic) flow. The CFD simulation includes a forward-facing cavity 44 having the constriction 58 (i.e., choke mechanism 54) incorporated into the entrance 46 to the cavity 44. As can be seen in FIG. 5, the bow shock 104 partially envelopes the nose section 16 and is formed as a result of the nose section 16 being subjected to hypersonic flow. FIG. 5 illustrates relative fluid pressures downstream of the bow shock 104 and represented by the cross-hatched areas between pressure contour 94 lines. On an exterior of the cavity 44, pressure may generally decrease along an aftwardly direction of the nose section 16. Within the cavity 44, the cavity basewall 50 pressure may oscillate at a reduced amplitude and at a higher mode relative to the larger amplitude of the first several cycles of cavity basewall 50 pressure oscillation similar to the CFD simulation 162 curve illustrated in FIG. 6 wherein the amplitude of the external drag coefficient 158 is reduced from its initially large amplitude. Advantageously, the damped pressure oscillations within the cavity 44 reduce cavity basewall 50 heating due to reduced velocity within the cavity 44 and reduced mass exchange with an exterior of the cavity 44.

Figure 6:
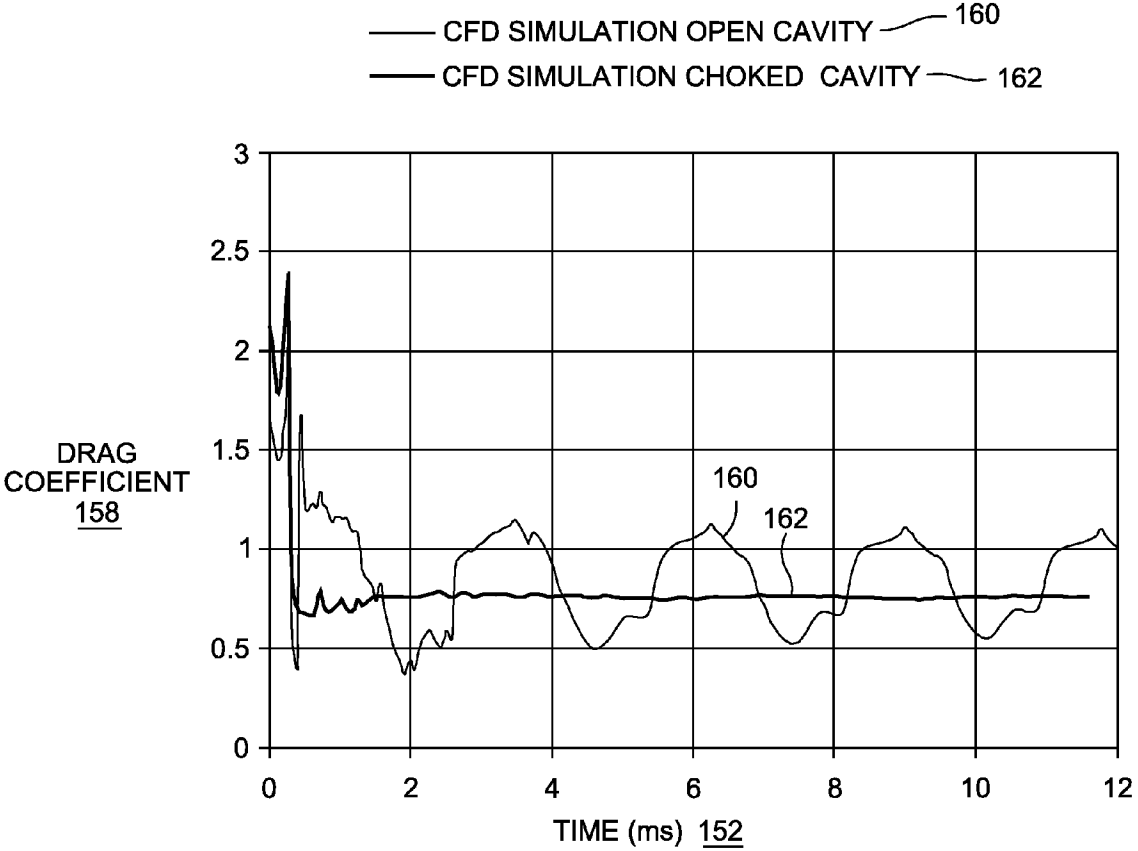
FIG. 6 is a plot of aerodynamic drag coefficient over time for a CFD simulation of a vehicle having an open cavity (i.e., without a constriction at the cavity entrance) superimposed over the plot for a vehicle having a choked cavity (i.e., with a constriction) and illustrating the relatively rapid damping of the oscillations in drag (coefficient) for the choked cavity as compared to the open cavity.
Figure 7:
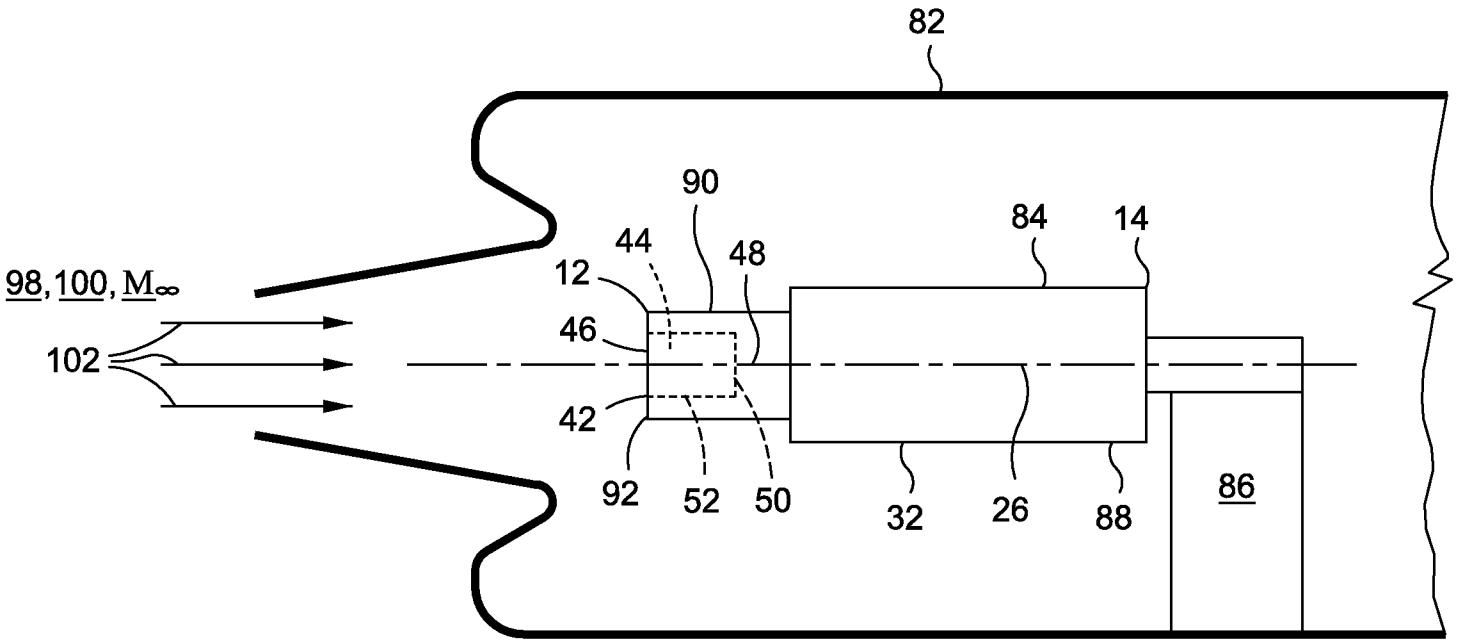
FIG. 7 is a sectional illustration of a shock tunnel having an open cavity test article mounted therewithin and subjected to a hypersonic flow (e.g., approximately Mach 8) for validating a CFD simulation of the open cavity configuration.

Referring to FIG. 6, shown is a plot of the coefficient of aerodynamic drag 158 over time 152 for a CFD simulation 160 of a vehicle 10 having an open cavity 92 similar to that which is illustrated in FIG. 7. The plot for the open cavity 92 configuration is superimposed over a CFD simulation 162 of a vehicle 10 having a choked cavity 96 (i.e., having a constriction 58 at the cavity 44 entrance 46) similar to that which is illustrated in FIGS. 1, 2, 4 and 5. As can be seen in FIG. 6, the CFD simulations for each of the open and choked cavity 92, 96 configurations illustrate a relatively large amplitude in drag coefficient 158 that occurs in the first several cycles of oscillation. For the open cavity 92 configuration, the amplitude of the oscillations reduce to a steady-state condition wherein the peak-to-peak amplitude of the drag coefficient 158 fluctuates between approximately 0.5 and approximately 1.2 for a difference of approximately 0.7.

In contrast, FIG. 6 illustrates that for the choked cavity 96 configuration, the initially large amplitude in drag coefficient 158 oscillations reduces to the steady-state condition wherein the peak-to-peak amplitude fluctuations in drag are on the order of less than 0.1. The reduction in drag coefficient 158 oscillations may correlate to the damping of the bow shock oscillations 106 due to the incorporation of the constriction 58 at the entrance 46 of the cavity 44. As illustrated in the plots of FIG. 6, the constriction 58 in the forward-facing cavity 44 facilitates a significant reduction in the bow shock oscillations 106 as represented by the generally uniform drag coefficient 158 value of approximately 0.7 for the choked cavity 96 configuration which varies by less than 0.1 for the duration of the CFD simulation 162.

Referring to FIG. 7, shown is an open cavity 92 test article 84 (i.e., formed without a constriction 58) mounted within a shock tunnel 82. The open cavity 92 test article 84 was subjected to Mach 7.88 flow at a zero degree angle-of-attack and a Reynolds number per foot of approximately $1.35\times10^6$ in order to validate the results of the CFD simulations for the open and choked cavity 92, 96 configurations illustrated in FIG. 6. More specifically, the test article 84 setup illustrated in FIG. 7 was used to generate experimental tunnel data comprising measurements of pressure exerted on the cavity 44 and on the external surfaces of the test article 84. The experimental tunnel data was compared to a CFD prediction (i.e., simulation) of the same test article 84 configuration illustrated in FIG. 7 using similar tools and a similar modeling approach as was used in the CFD simulation illustrated in FIG. 6.

Referring still to FIG. 7, it can be seen that the test article 84 is comprised of an article body 88 and is supported by a support 86 located at the aft end 14 of the test article 84. The test article 84 terminates at a forward end 12 wherein the cavity 44 is mounted in the nose section 90 of the test article 84. The cavity 44 is defined by a cavity sidewall 52 and cavity basewall 50 and has a cavity axis 48 that is aligned with the longitudinal axis 26 of the test article 84 and with the free stream 100 flow direction 102. The open cavity 92 at the nose rim 42 of the nose section 90 was subjected to hypersonic flow along the indicated direction to compare the predicted pressure at the cavity basewall 50 to the actual or measured pressure exerted on the cavity basewall 50 during shock tunnel 82 testing. Likewise, the predicted pressures on the external surfaces of the test article 84 were compared to measurements of external pressure recorded during shock tunnel 82 testing.

Figure 8:
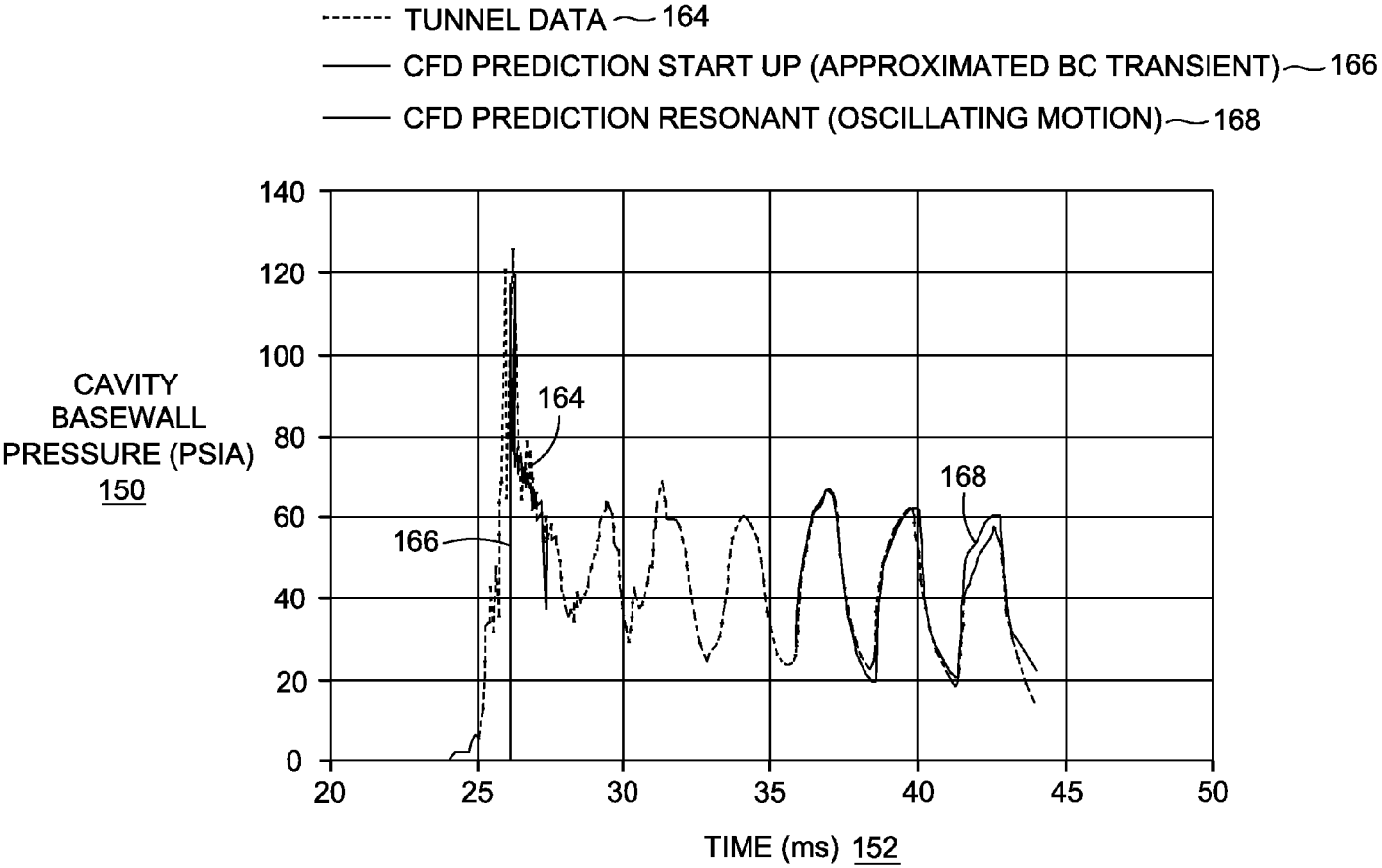
FIG. 8 is a plot of cavity basewall pressure over time and including a CFD prediction of fluctuations in cavity basewall pressure in comparison to experimental data measured on the shock tunnel test article of FIG. 7.

Referring to FIG. 8, shown is a plot of cavity basewall pressure 150 measured over time 152 for a CFD prediction 166, 168 of cavity basewall pressure 150 as compared to pressure measured at the cavity basewall 50 for the test article 84 illustrated in FIG. 7. In FIG. 7, the curves shown in solid represent the CFD predictions 166, 168 and are superimposed over the curves shown in dashed which represent the tunnel data 164 comprising actual measurements of cavity basewall pressure 150. The CFD prediction 166, 168 curves are broken into two portions with the first portion comprising the CFD prediction 166 during startup for the first several cycles of oscillation of cavity basewall pressure 150. The second part of the CFD prediction 168 represents the generally steady state cavity basewall pressure 150 oscillations at reduced amplitude.

As can be seen, the CFD prediction 166, 168 of cavity basewall pressure in FIG. 8 closely matches the tunnel data 164 representing actual measured cavity basewall pressure 150. In this regard, the close correlation between the CFD predictions 166, 168 and the measured tunnel data 164 for the open cavity 92 in FIG. 8 validates the CFD modeling 162 (i.e., simulation) of the choked cavity 96 configuration in FIG. 6 and which indicates that positioning the constriction 58 in the cavity 44 such as at the entrance 46 facilitates a significant reduction in bow shock oscillation 106.

Figure 10:
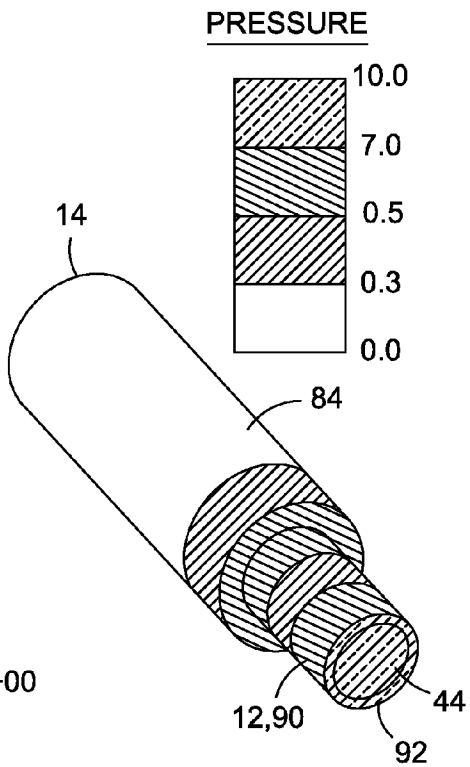
FIG. 10 is a perspective illustration of the test article shown mounted in the shock tunnel of FIG. 7 and further illustrating external pressure measured at different locations along the test article and corresponding to the experimental data illustrated in FIG. 9.
Figure 9:
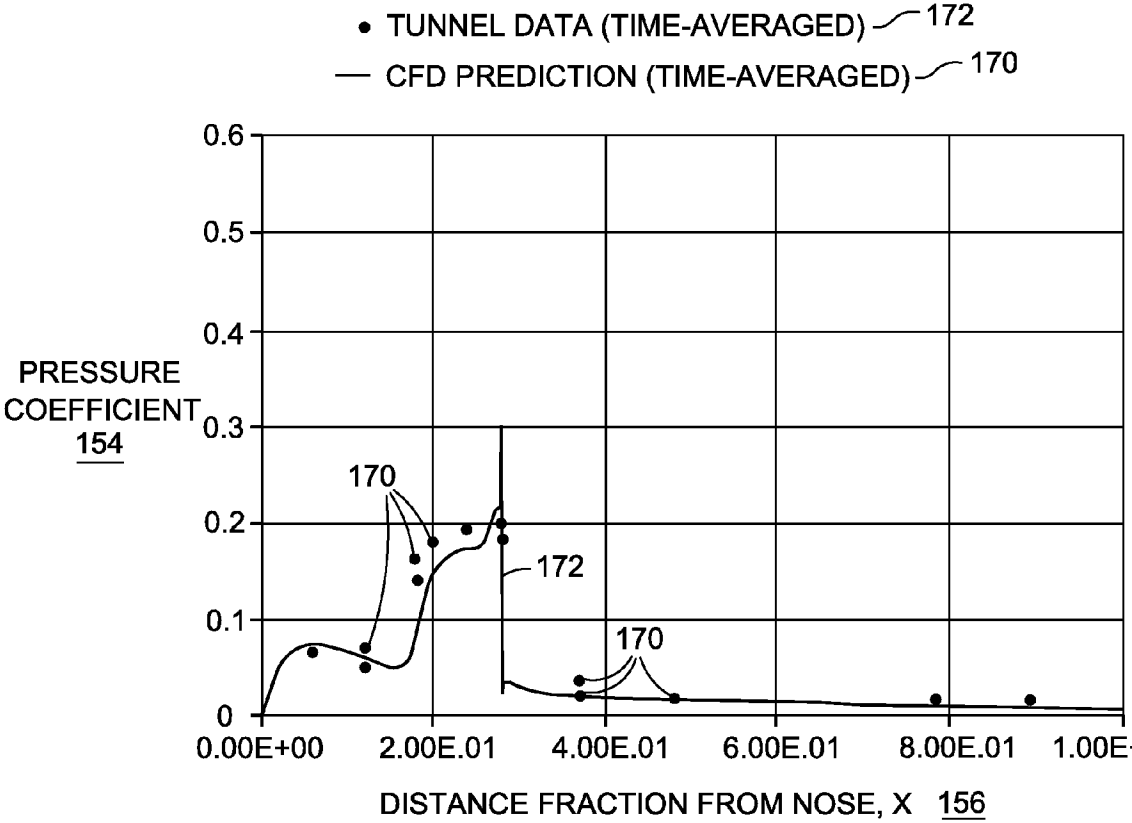
FIG. 9 is a plot of pressure coefficient over time of the external surfaces of the shock tunnel test article of FIG. 7 and illustrating experimental data points measured during shock tunnel testing in comparison to a CFD prediction thereof.

Referring to FIGS. 9 and 10, shown in FIG. 9 is a plot of the coefficient of pressure 154 of the external surfaces of the test article 84 as a function of distance fraction 156 from the nose tip 20. FIG. 10 graphically represents relative pressures exerted on the external surfaces of the open cavity 92 test article 84 in correspondence to the plot of pressure coefficient 154 illustrated in FIG. 9. As can be seen in FIG. 9, the CFD prediction 172 of external pressure exerted on the test article 84 illustrated in FIG. 7 closely matches the tunnel data 170 comprising the actual or measured pressure exerted on the test article 84. In this regard, FIG. 9 further validates the CFD modeling 162 of the choked cavity 96 configuration illustrated in FIG. 6 indicating that the cavity 44 constriction 58 positioned at the cavity 44 entrance 46 facilitates a significant reduction in bow shock oscillation 106.

Figure 11:
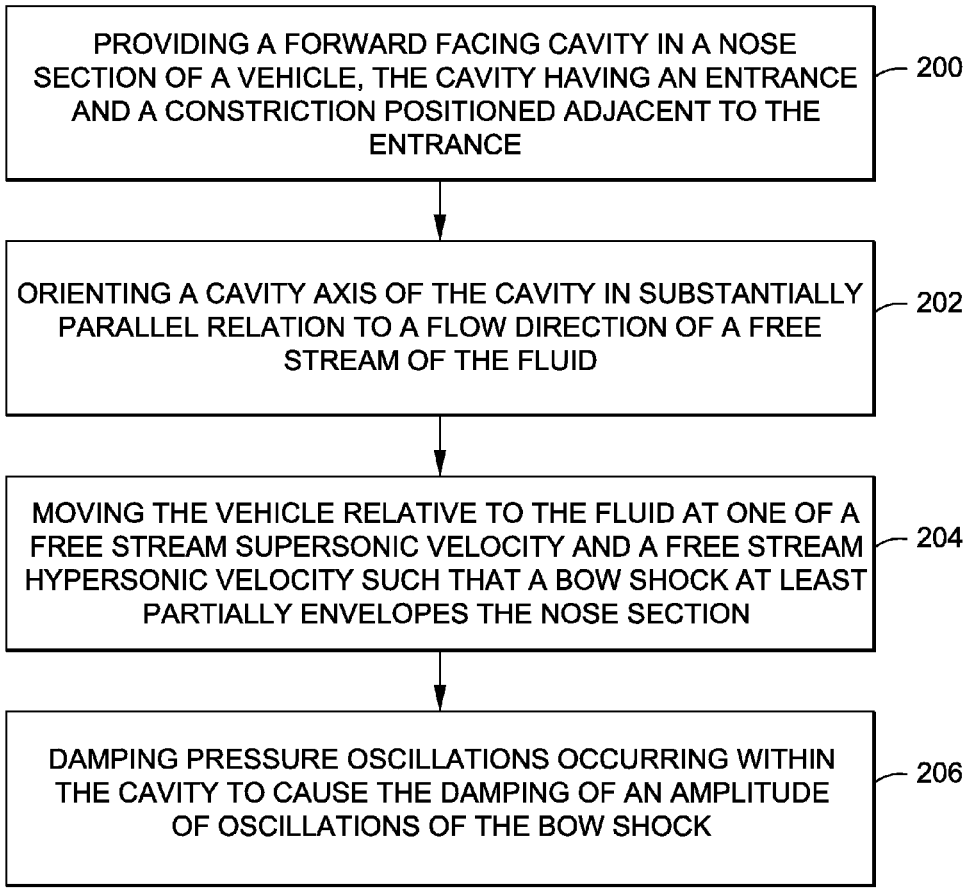
FIG. 11 is a flow diagram illustrating a methodology for damping oscillations of a bow shock of a vehicle.

Referring to FIG. 11, shown is a flow diagram illustrating a methodology for damping oscillations of a bow shock 104 of a vehicle 10. In the methodology, step 200 comprises providing the forward-facing cavity 44 in the vehicle 10 such as a nose section 16 thereof. The cavity 44 may be forward-facing as illustrated in FIGS. 1, 2 and 4 as described above and may include the constriction 58 formed at or adjacent to the entrance 46 of the cavity 44. However, as was indicated above, the cavity 44 and constriction 58 may be positioned at any location in a vehicular or non-vehicular application. For example, the cavity 44 may be located in a sidewall of the vehicle 10 wherein the entrance 46 of the cavity 44 may be exposed to tangential flow of the free stream 100 relative to the cavity axis 48.

Additionally, it is contemplated that the methodology illustrated in FIG. 11 may comprise providing the cavity 44 at other locations in a vehicular or non-vehicular application. For example, the cavity 44 may be disposed on an aft end 14 of a vehicle 10 wherein the cavity 44 is not directly exposed to the oncoming fluid 98 flow but may be affected by a flow dynamic that may induce pressure oscillations 62 within the cavity 44 and which may be damped by the constriction 58. Even further, the cavity 44 may be installed in locations or applications that are not directly affected by free stream 100 flow. For example, it is contemplated that the cavity 44 may be installed in high speed flows associated with the exhaust of a turbine engine or the plume of a rocket engine.

Step 202 may comprise orienting the cavity axis 48 in substantially parallel relation to the flow direction 102 of the free stream 100. However, as indicated above, the cavity axis 48 may be oriented in any relation to the free stream 100 and is not limited to alignment therewith. For example, as shown in FIG. 3, the cavity axis 48 may be oriented in substantially perpendicular relation to the flow direction 102 of the free stream 100. Furthermore, the cavity axis 48 may be oriented in other directions relative to the free stream 100 flow direction 102 and/or relative to one or more features of the vehicle 10 as described above.

In FIG. 11, step 204 comprises moving the vehicle 10 or cavity 44 relative to a fluid 98 such as an oncoming free stream 100 flow at any one of a variety of flow velocities. For example, the vehicle 10 or structure containing the cavity 44 may be moved relative to a supersonic flow and/or a hypersonic flow. For forward-facing cavities mounted on the nose section 16 of a vehicle, the vehicle 10 may be subjected to a supersonic or hypersonic flow such that the bow shock 104 at least partially envelopes the nose section. However, as indicated above, the cavity 44 may be mounted at other locations along the vehicle 10 or structure which may not be subject to bow shock formation. For example, the cavity 44 may be mounted on a leading edge of an aerodynamic surface such as along a wing or a control surface of a missile, re-entry vehicle, or any other supersonic or hypersonic air vehicle 10.

Referring still to FIG. 11, the methodology may include step 206 of damping pressure oscillations 62 occurring within the cavity 44 in order to dampen the amplitude of the bow shock oscillations 106. As indicated above, the bow shock 104 may form in a detached position forward of the nose section 16 of a vehicle 10 and may oscillate at a significant amplitude unless otherwise damped by incorporating the constriction 58 in the entrance 46 of the cavity 44 as illustrated in FIGS. 2, 4 and 5. In this regard, the constriction 58 may preferably be sized to dampen the amplitude of pressure oscillations 62 occurring within the cavity 44 in order to reduce the bow shock oscillations 106. Likewise, the constriction 58 may be sized to minimize oscillations in the magnitude of pressure acting on the cavity basewall 50 in order to reduce heat flux or heat transfer from the cavity 44 fluid into the cavity basewall 50 and thereby maintain the cavity basewall 50 at a desired temperature.

As illustrated in FIGS. 2, 4 and 5, the cavity axis 48 may be oriented to be in substantially parallel relation to the flow direction 102 of the free stream 100 although the cavity axis 48 may be oriented in any relation to the free stream 100 and is not limited to alignment therewith. Damping of the bow shock oscillations 106 may be enhanced by sizing the constriction width $D_2$ in relation to the cavity width $D_1$ (i.e., cavity width ratio). For example, the constriction width $D_2$ may be formed at a ratio of from approximately 0.3 to approximately 0.7 relative to the cavity width $D_1$ and, more preferably, at a cavity width ratio of approximately 0.5. Likewise, effectiveness of the damping of the bow shock oscillations 106 may be related to the aspect ratio of the cavity 44. More specifically, the cavity 44 geometry may be such that the cavity depth L is sized as a function of cavity width $D_1$. In an example, the cavity 44 may be formed at a ratio of cavity depth L to cavity width $D_1$ (i.e., cavity depth ratio) of from approximately 0.5 to approximately 1.5 and, more preferably, at a cavity depth ratio of approximately 1.0. However, as was indicated above, the cavity width ratio and the cavity depth ratio are not limited to the specific ranges indicated above but may be provided in any ratio.

In regard to cavity 44 and constriction 58 geometry, the cavity 44 is not limited to a cylindrical configuration but may comprise any geometric size and/or shape or any combination thereof. Likewise, the constriction 58 may be provided in a circular shape but may optionally be provided in any one of a variety of alternative shapes, sizes and configurations in order to effectuate a specific or desired damping response of the bow shock oscillations 106. For example, the constriction 58 may be sized to minimize variations of the drag coefficient of the vehicle 10 in order to simplify vehicle 10 control. Likewise, the constriction 58 may be sized to improve the quality of signal transmission from the cavity basewall 50 through the cavity 44 and which may improve imaging such as target seeking or tracking.

Additional modifications and improvements of the present disclosure may be apparent to those of ordinary skill in the art. Thus, the particular combination of parts described and illustrated herein is intended to represent only certain embodiments of the present disclosure and is not intended to serve as limitations of alternative embodiments or devices within the spirit and scope of the disclosure.

What is claimed is:

1. An oscillation damping mechanism, comprising:
a cavity of a vehicle moving relative to at least one of a supersonic and hypersonic free stream;
the cavity having an entrance exposed to fluid flowing exterior to the cavity;
a constriction positioned adjacent to the entrance and being sized to dampen pressure oscillations occurring within the cavity; and
the constriction being formed as an annular step extending around a cavity sidewall, the annular step being oriented at an angle relative to the cavity sidewall such that the cavity sidewall is non-continuous.

2. The damping mechanism of claim 1 wherein:
the cavity extending to a cavity basewall;
the constriction being sized to minimize oscillations in pressure acting on the cavity basewall.

3. The damping mechanism of claim 1 wherein:
the cavity defines a cavity axis;
the free stream moving along a flow direction;
the cavity axis being oriented in one of a substantially parallel and a substantially perpendicular relation to the free stream flow direction.

4. The damping mechanism of claim 3 wherein:
the cavity is formed on a lateral side of a vehicle;
the cavity axis being oriented substantially perpendicularly relative to the free stream flow direction.

5. The damping mechanism of claim 1 wherein:
the cavity is formed in a nose section of a vehicle;
the entrance being forward-facing.

6. The damping mechanism of claim 5 wherein:
the cavity is formed on a forward-most end of the nose section.

7. The damping mechanism of claim 5 wherein:
the nose section is at least partially enveloped by a bow shock;
the constriction being sized to dampen an amplitude of oscillations of the bow shock.

8. The damping mechanism of claim 1 wherein:
the cavity defines a cavity width;
the constriction defining a constriction width being less than the cavity width;
the ratio of the constriction width to the cavity width being in the range of from approximately 0.3 to approximately 0.7.

9. The damping mechanism of claim 8 wherein:
the ratio of the constriction width to the cavity width is approximately 0.5.

10. The damping mechanism of claim 8 wherein:
the cavity defines a cavity depth;
the ratio of the cavity depth to the cavity width being in the range of from approximately 0.5 to approximately 1.5.

11. The damping mechanism of claim 10 wherein:
the ratio of the cavity depth to cavity width is approximately 1.0.

12. The damping mechanism of claim 1 wherein:
the vehicle is comprised of at least one of the following: a projectile, a missile, a re-entry vehicle, an aircraft.

13. The damping mechanism of claim 1 wherein:
the cavity is formed in a vehicle;
the constriction being sized to minimize variations of a drag coefficient of the vehicle measured over time.

14. A vehicle, comprising:
a body portion of a vehicle moving relative to at least one of a supersonic and hypersonic free stream;
a cavity formed in the body portion and having an entrance exposed to fluid flowing relative thereto;
a constriction formed in the cavity adjacent to the entrance and being sized to dampen an amplitude of pressure oscillations occurring within the cavity; and
the constriction being formed as an annular step extending around a cavity sidewall, the annular step being oriented at an angle relative to the cavity sidewall such that the cavity sidewall is non-continuous.

15. The vehicle of claim 14 wherein:
the cavity defines a cavity axis;
the fluid moving in a free stream along a flow direction;
the cavity axis being oriented in one of a substantially parallel and a substantially perpendicular direction relative to the free stream flow direction.

16. The vehicle of claim 14 wherein:
the cavity is formed in a nose section of the vehicle;
the entrance being forward-facing.

17. The vehicle of claim 14 wherein:

the nose section is at least partially enveloped by a bow shock when the vehicle is subjected to the at least one of supersonic and hypersonic flow;

the constriction being sized to dampen an amplitude of oscillations of the bow shock.

18. The vehicle of claim 14 wherein:

the vehicle being comprised of at least one of the following: a projectile, a missile, a re-entry vehicle, an aircraft.

19. The vehicle of claim 18 wherein:

the cavity includes a cavity basewall having a sensor window mounted adjacent thereto.

20. The vehicle of claim 14 wherein:

the constriction is sized to minimize variations of a drag coefficient of the vehicle over time.

21. A method of damping pressure oscillations occurring within a cavity formed in a vehicle moving relative to at least one of a supersonic and hypersonic free stream, the cavity having an entrance, the method comprising the steps of:

positioning a constriction in the cavity adjacent the cavity entrance, the constriction being formed as an annular step extending around a cavity sidewall, the annular step being oriented at an angle relative to the cavity sidewall such that the cavity sidewall is non-continuous; and damping an amplitude of the pressure oscillations occurring within the cavity.

22. The method of claim 21 wherein the cavity includes a cavity basewall, the method further comprising the step of:

sizing the constriction to minimize oscillations in a magnitude of pressure acting on the cavity basewall.

23. The method of claim 22 further comprising the step of:

sizing the constriction to minimize heat transfer from cavity fluid to the cavity basewall.

24. The method of claim 21 wherein the vehicle includes a nose section being at least partially enveloped by a bow shock when subjected to the at least one of supersonic and hypersonic flow, the method further comprising the step of:

sizing the constriction to dampen an amplitude of oscillations of the bow shock.

25. The method of claim 21 wherein the cavity defines a cavity width, the constriction defining a constriction width, the method further comprising the step of:

forming the constriction width at a ratio of from approximately 0.3 to approximately 0.7 relative to the cavity width.

26. The method of claim 25 wherein the cavity defines a cavity depth, the method further comprising the step of:

forming the cavity at a ratio of cavity depth to cavity width of from approximately 0.5 to approximately 1.5.

* * * * *